US010800125B2

(12) United States Patent
Yu

(10) Patent No.: US 10,800,125 B2
(45) Date of Patent: Oct. 13, 2020

(54) WRITING INSTRUMENT COMPRESSING DEVICE

(71) Applicant: Ben Yu, Taichung (TW)

(72) Inventor: Ben Yu, Taichung (TW)

( * ) Notice: Subject to any disclaimer, the term of this patent is extended or adjusted under 35 U.S.C. 154(b) by 248 days.

(21) Appl. No.: 16/159,724

(22) Filed: Oct. 15, 2018

(65) Prior Publication Data

US 2020/0114609 A1 Apr. 16, 2020

(51) Int. Cl.

| | |
|---|---|
| ***B30B 15/28*** | (2006.01) |
| ***B30B 15/00*** | (2006.01) |
| ***B30B 1/04*** | (2006.01) |
| ***B43K 15/00*** | (2006.01) |

(52) U.S. Cl.

CPC ..... *B30B 15/288* (2013.01); *B30B 1/04* (2013.01); *B30B 15/0035* (2013.01); *B43K 15/00* (2013.01)

(58) Field of Classification Search

CPC ..... Y10T 29/53383; Y10T 29/53387; Y10T 29/53396; Y10T 29/53678; Y10T 29/5397; B43K 15/00; B30B 1/02; B30B 1/04

See application file for complete search history.

(56) References Cited

U.S. PATENT DOCUMENTS

| | | | | |
|---|---|---|---|---|
| 7,421,768 | B2 * | 9/2008 | Chiang | B25B 11/02 269/43 |
| 2008/0040909 | A1 * | 2/2008 | Zimmermann | B23P 19/02 29/525 |
| 2011/0094077 | A1 * | 4/2011 | Siddall | B25B 27/10 29/281.1 |
| 2018/0304671 | A1 * | 10/2018 | Liu | B43K 15/00 |
| 2019/0308441 | A1 * | 10/2019 | Walters | B43K 25/022 |

* cited by examiner

*Primary Examiner* — Tyrone V Hall, Jr.
(74) *Attorney, Agent, or Firm* — Leong C. Lei

(57) ABSTRACT

A writing instrument compressing device includes a base having an underside mounted to multiple raiser pieces to have the base separate from a carrying surface by a distance in a vertical direction. The base includes an elongate hole that is delimited by two opposite sidewalls each including tooth ridges and the tooth troughs alternately arranged. A handle rod is pivoted to an end of the base to drive reciprocal movement of a pusher. A retainer is reciprocally movable along the elongate hole of the base and functions to clamp and fix a writing instrument body or a tool. The retainer is provided, on a bottom thereof, with a screw rod extending through the elongate hole of the base. A tightening assembly includes a nut and a rotation bar horizontally penetrating through the nut and having two ends selectively moved close to the nut.

8 Claims, 14 Drawing Sheets

WRITING INSTRUMENT COMPRESSING DEVICE

TECHNICAL FIELD OF THE INVENTION

The present invention relates generally to a device for compressing a writing instrument, and more particularly to a writing instrument compressing device that is operable to combine a wooden writing instrument body and a writing instrument part without causing positional deviation and displacement.

DESCRIPTION OF THE PRIOR ART

Referring to FIGS. 1 and 2, a prior art writing instrument compressing device 10 is shown. The prior art writing instrument compressing device 10 is useful in combining and fixing a writing instrument body 154 and a writing instrument head portion 155 together. The prior art writing instrument compressing device 10 comprises a base 11. The base 11 is formed therein with an elongate hole 111. The elongate hole 111 has two opposite sidewalls, which comprises, corresponding to each other, tooth ridges 112 and tooth troughs 113 alternately arranged in a linear array. The base 11 is provided, on a top surface thereof, with a pivot seat 131. The pivot seat 131 is provided, at one end thereof, with a pivot pin 133 with which a lower end of a handle rod 12 is pivotally mounted. An opposite end of the pivot seat 131 comprises a guide section 132. The lower end of the handle rod 12 is pivotally mounted, at an opposite side thereof, to a link bar 13. An opposite end of the link bar 13 is pivotally connected to a pusher 14. The pusher 14 is received, in a rotatable manner, through the guide section 132 so as to form a rotatable coupling relationship with respect to the link bar 13. The handle rod 12 controls a reciprocal movement of the pusher 14. The base 11 is also provided, at an opposite end of the top surface thereof, with a reciprocally movable retainer 15. The retainer 15 comprises an upper seat 151 and a lower seat 152. The lower seat 152 is provided with two bolts (not shown in the drawings) extending upward to penetrate through the upper seat 151, such that the upper seat 151 is movable in a vertical direction along the two bolts. Depending on working requirement, a supporter 153 is arranged between the upper seat 151 and the lower seat 152 and a rotary knob 16, 17 set in engagement with each of the bolts are moveable, through threading engagement therebetween, downward to have the supporter 153 securely clamped and fixed between the upper seat 151 and the lower seat 152. A clamping plate 18 is arranged on a lower side of the base 11. The clamping plate 18 is assembled with the lower seat 152 by two connection bolts 181, 182 extending through the elongate hole 111 such that the clamping plate 18, the base 11, and the lower seat 152 are not set in a tightly engaged manner to allow the clamping plate 18, the upper seat 151, and the lower seat 152 to be reciprocally movable on the base 11. The lower seat 152 is provided with a stop member 19 pivotally mounted thereto. The stop member 19 is provided, on each of two opposite side portions thereof, with a manual operation section 191, and a fixing plate 192 extending downward is arranged on a bottom of a middle portion thereof. When the manual operation sections 191 are lifted to make one side of the stop member 19 moved upward so as to have the fixing plate 192 disengaging from the tooth troughs 113 on the two sidewalls of the elongate hole 111, the retainer 15 and the clamping plate 18 are allowed to move along the elongate hole 111; and when the stop member 19 is lowered down, the fixing plate 192 is set into engagement with two opposite ones of the tooth troughs 113 to be retained in position by the tooth ridges 112 thereby preventing the retainer 15 from moving, allowing the writing instrument head portion 155 and the writing instrument body 154 to be positioned between the supporter 153 and the pusher 14 in a manner of being in slight contact with each other. When the handle rod 12 is operated to cause the pusher 14 to move forward, the writing instrument head portion 155 is forced to fit into the writing instrument body 154 to combine therewith. The prior art writing instrument compressing device 10, however, suffers the following shortcomings:

(1) The prior art writing instrument compressing device 10 uses two rotary knobs 16, 17 to screw downward to have the upper seat 151 and the lower seat 152 tightly fix the supporter 153 in position. The two rotary knobs 16, 17, when operated, might get interfering with each other and an extended period of time is required for completing the operation, making it poor in efficiency and inconvenient in operation.

(2) To allow for fast reciprocal movement, a gap is kept between the retainer 15 and the clamping plate 18 and to allow the fixing plate 192 to be readily received into the tooth troughs 113, there must be clearances between the fixing plate 192 and the tooth troughs 113. Consequently, when the pusher 14 applies a force to the writing instrument body 154, the writing instrument head portion 155, and the supporter 153, the retainer 15 on which the supporter 153 is attached would undergo potential risk of being forced to deviate by an angle, causing a deviation angle present between the writing instrument body and the writing instrument head portion when they are to combine with each other and eventually leading to cracking or even breaking of the writing instrument body, which is a relatively weak one of the two.

SUMMARY OF THE INVENTION

The primary objective of the present invention is to provide a writing instrument compressing device, which allows a writing instrument body and a writing instrument part to be positioned in linear alignment with each other in a process of being coupled to each other so that cracking or breaking of the writing instrument body or the writing instrument part does not occur.

Another objective of the present invention is to provide a writing instrument compressing device, which allows a tightening operation to be carried out through screwing with one single rotary knob so as to improve operation efficiency.

A further objective of the present invention is to provide a writing instrument compressing device, which comprises a plurality of raiser pieces arranged under a base so that the base is selectively lifted away from a carrying surface by a height to allow for easy adjustment of a rotation bar during an operation.

To achieve the above objectives, the present invention provides a structure that comprises a base. The base has an underside on which a plurality of raiser pieces are mounted to separate the base away from a carrying surface by a distance in a vertical direction. The base is formed with an elongate hole. The elongate hole is defined by two opposite sidewalls, which are provided, in a manner of corresponding to and opposite to each other, tooth ridges and tooth troughs arranged alternate with each other. A handle rod is pivotally coupled to an end of the base to drive a pusher to reciprocally move. A retainer is reciprocally movable along the elongate hole of the base and functions to clamp or fix a writing instrument body or a tool. The retainer is provided, on a bottom surface thereof, with a screw rod that extends through the elongate hole of the base. A tightening assembly comprises a nut and a rotation bar that penetrates through the nut and is rotatable The nut is screwed to the screw rod on the bottom surface of the retainer. The rotation bar has two ends, wherein one of the two ends is movable close to the nut, while the other one of the two ends is moved away from the nut. The nut is driven by the rotation bar to tighten the retainer and the base or to be loosened to allow the retainer to reciprocally move on the base.

With the above-described structural arrangement, when a writing instrument body and a writing instrument part that are to be combined together are positioned between the pusher and the retainer, since the retainer is arranged such that through the nut being driven by the rotation bar to have the retainer and the base securely fixed together through screwing, the retainer does not undergo positional or angular deviation, so that the writing instrument body and the writing instrument part can be combined with each other in a manner of being in linear alignment with each other, thereby preventing cracking or breaking of the writing instrument body or the writing instrument part. In addition, the arrangement of the raiser pieces, adjustment or operation of the rotation bar can be conducted easily even during an operation.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
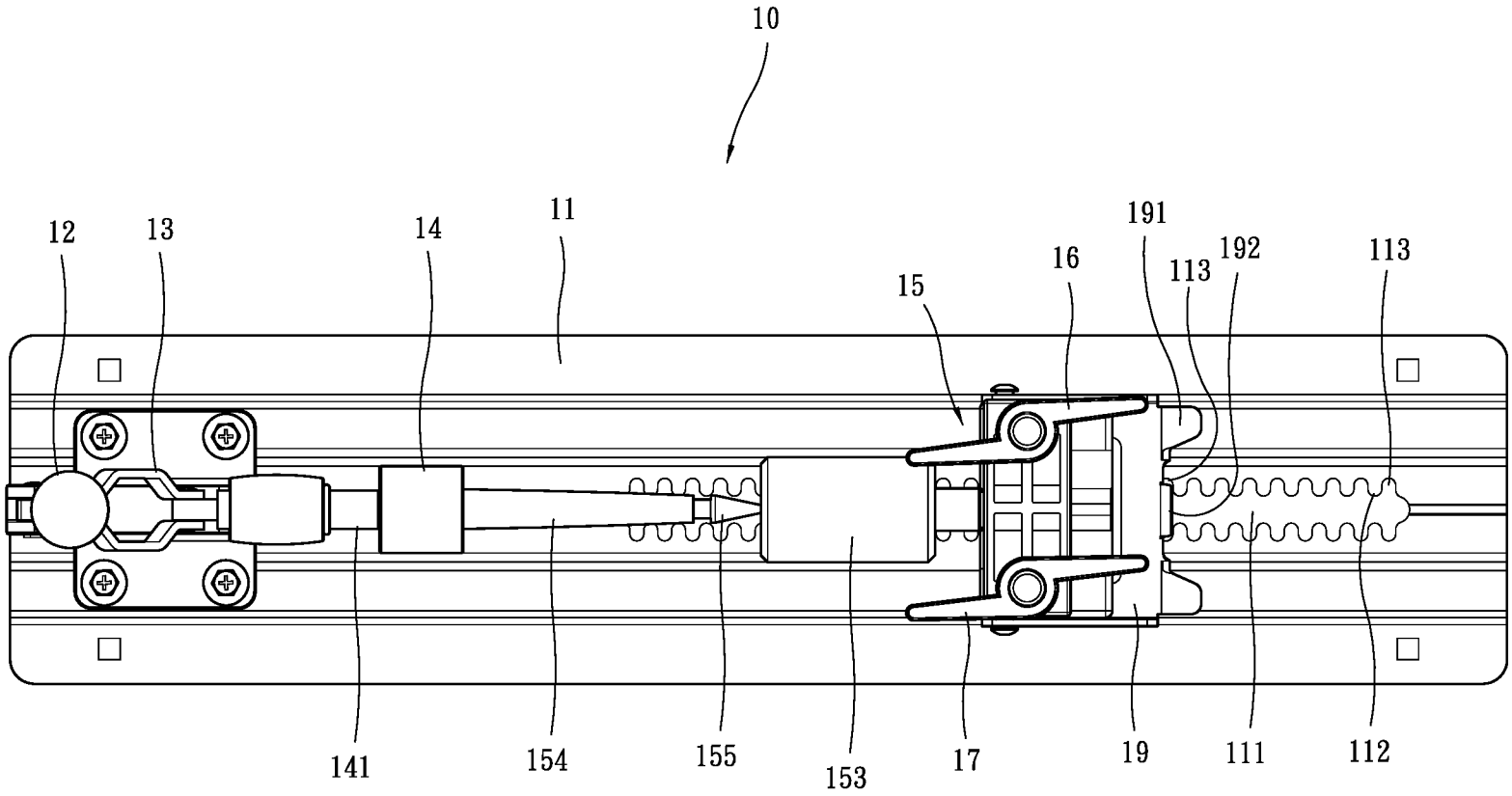
PRIOR ART FIG. 1
FIG. 1 is a top plan view, in a schematic form, illustrating a conventional writing instrument compressing device.
Figure 2:
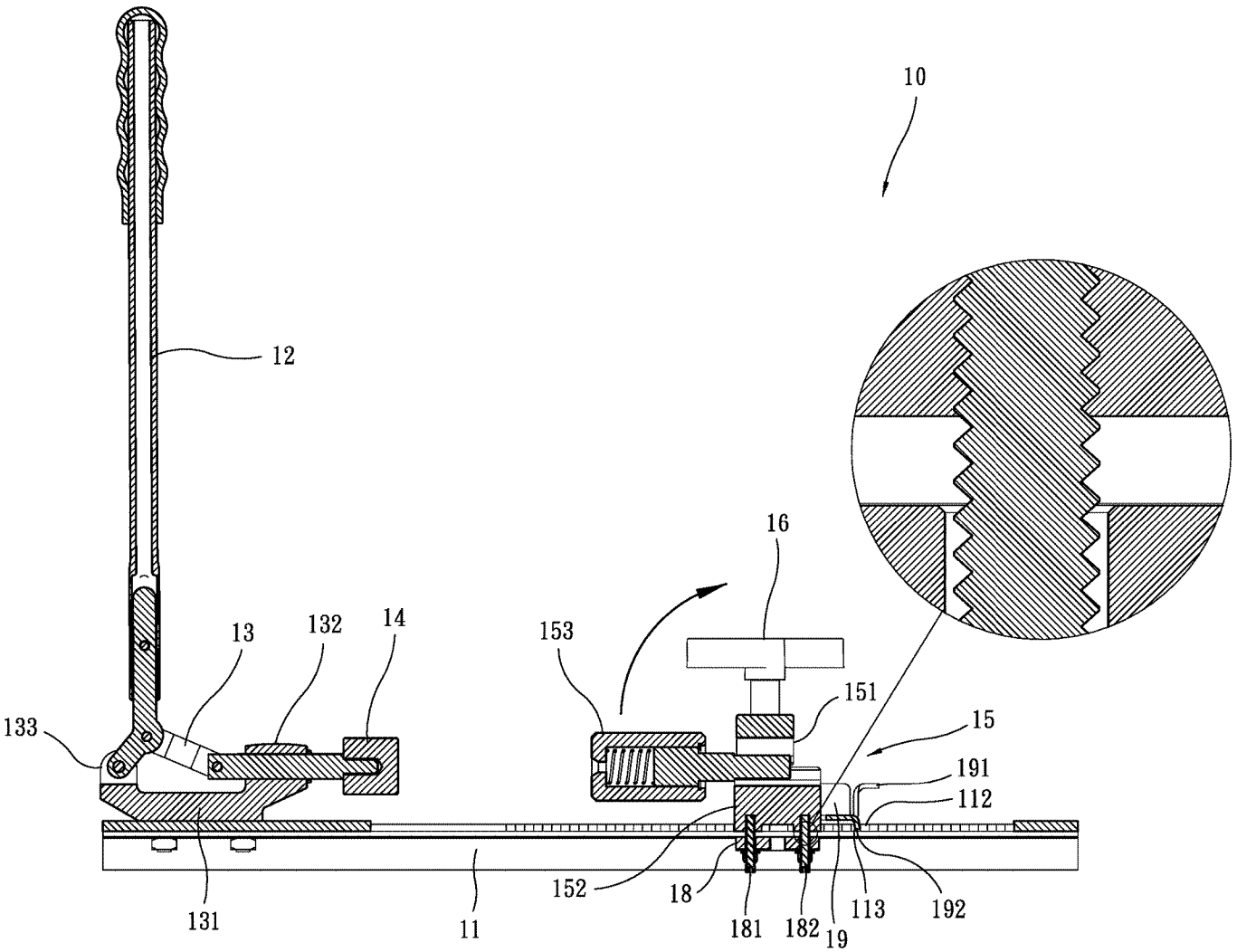
PRIOR ART FIG. 2
FIG. 2 is a cross-sectional view illustrating the conventional writing instrument compressing device.
Figure 3:
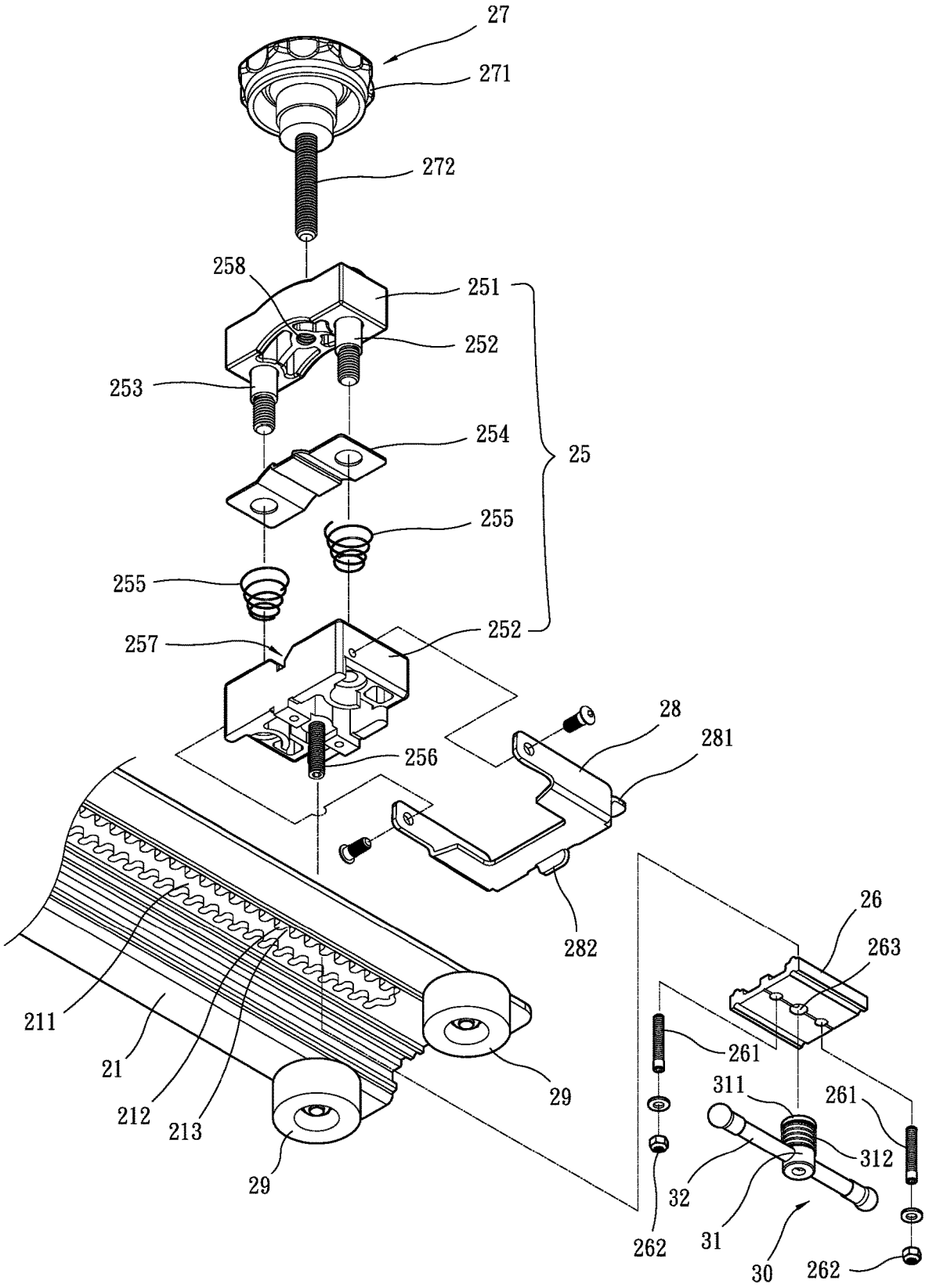
FIG. 3 is an exploded view illustrating an embodiment of the present invention.
Figure 4:
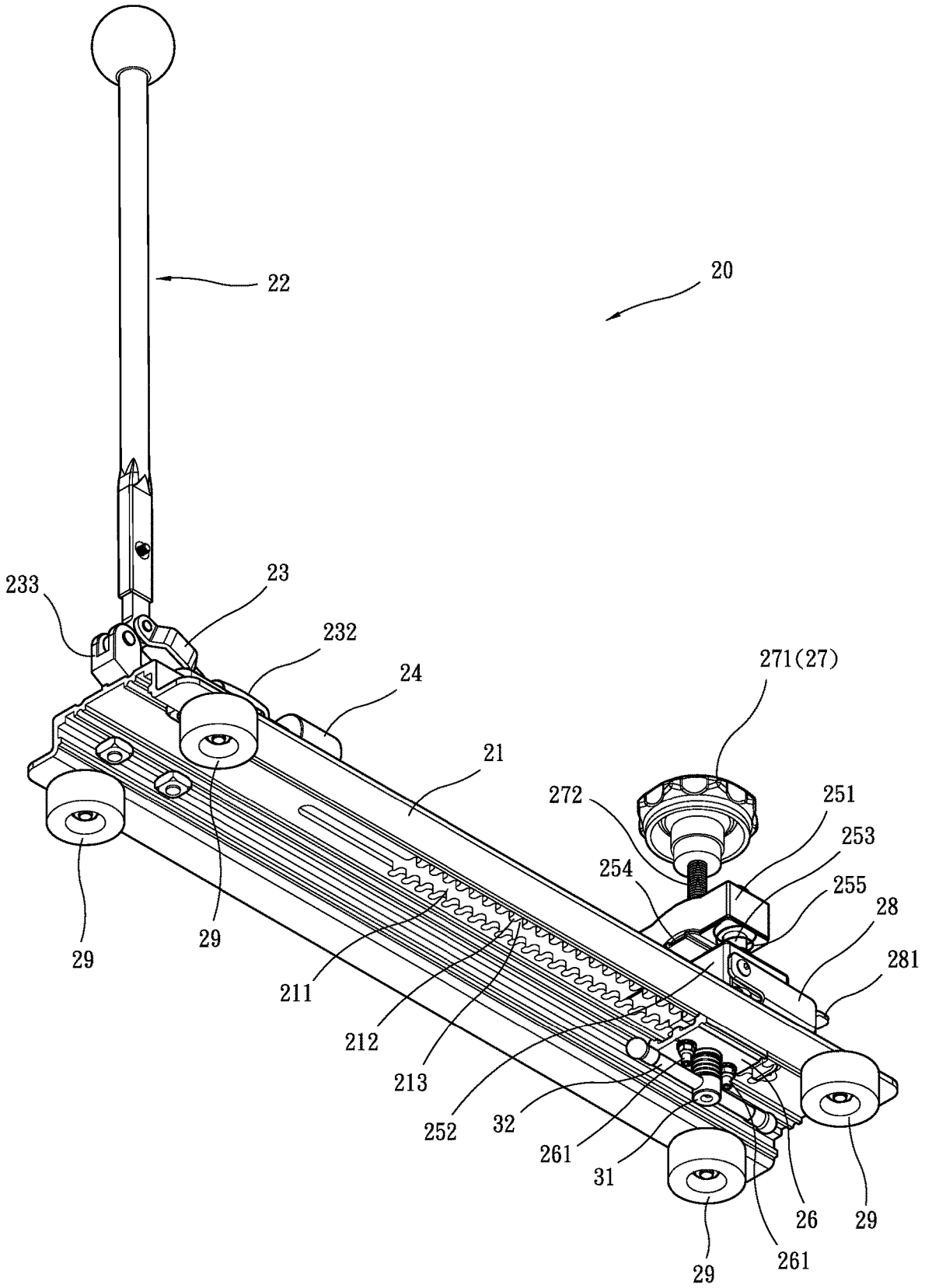
FIGS. 4 and 5 are perspective views, in an assembled form, illustrating the embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 3-6 and 10, in an embodiment of the present invention, a writing instrument compressing device 20 comprises a base 21, a pivot seat 231, a handle rod 22, a pusher 24, a retainer 25, a fastening member 27, a stop member 28, a clamp plate 26, and a tightening assembly 30.

The base 21 has an underside on which a plurality of raiser pieces 29 are mounted to separate the base 21 from a carrying surface by a predetermined vertical distance or height and a surface that comprises an elongate hole 211 penetrating therethrough in the vertical direction. The elongate hole 211 is delimited by two opposite sidewalls, which are provided, in a manner of corresponding to and opposite to each other, tooth ridges 212 and tooth troughs 213 arranged alternate with each other.

The pivot seat 231 is fixed at one end of the base 21. The pivot seat 231 is provided, on one side thereof, with a pivot pin 233 and is also provided, on an opposite side thereof, with a guide section 232, wherein the guide section 232 is formed as a channel or is formed with a channel having two ends in communication with each other.

The handle rod 22 comprises an elongate rod having a lower end of which one side is pivotally coupled to the pivot pin 233 of the pivot seat 231 and an opposite side is pivotally coupled to a link bar 23.

The pusher 24 has one end that is reduced in an outside diameter thereof to form a reduced section 241, which extends, in a rotatable manner, through the guide section 232 to pivotally couple to the link bar 23, and an opposite end that is expanded so that the handle rod 22, when swinging downward or upward, drives the link bar 23 to cause the pusher 24 to move reciprocally.

The retainer 25 comprises at least an upper seat 251 and a lower seat 252. The upper seat 251 and the lower seat 252 are spaced from each other by two support posts 253 that are coupled to the upper seat 251 and the lower seat 252. A holding plate 254 is arranged between the upper seat 251 and the lower seat 252 and the holding plate 254 is structured to allow the two support posts 253 to extend therethrough. The holding plate 254 is movable in the vertical direction along the two support posts 253. Each of the support posts 253 is provided with a spring 255 encompassing an outer circumference thereof, and the spring 255 is located between the holding plate 254 and the lower seat 252. The two springs 255 provide biasing spring forces that constantly set the holding plate 254 in a vertically lifted condition. Each of springs 255 includes turns of which diameters are increased from one end toward the opposite end so that when the spring is compressed, the turns are not stacked on each other. The upper seat 251 is formed in a middle portion thereof with a threaded hole 258 that extends therethrough in the vertical direction. The lower seat 252 has a top surface in which a receiving trough 257 is formed. Also, the lower seat 252 is provided in a middle portion of a bottom surface thereof with a downward pointing screw rod 256.

Figure 7:
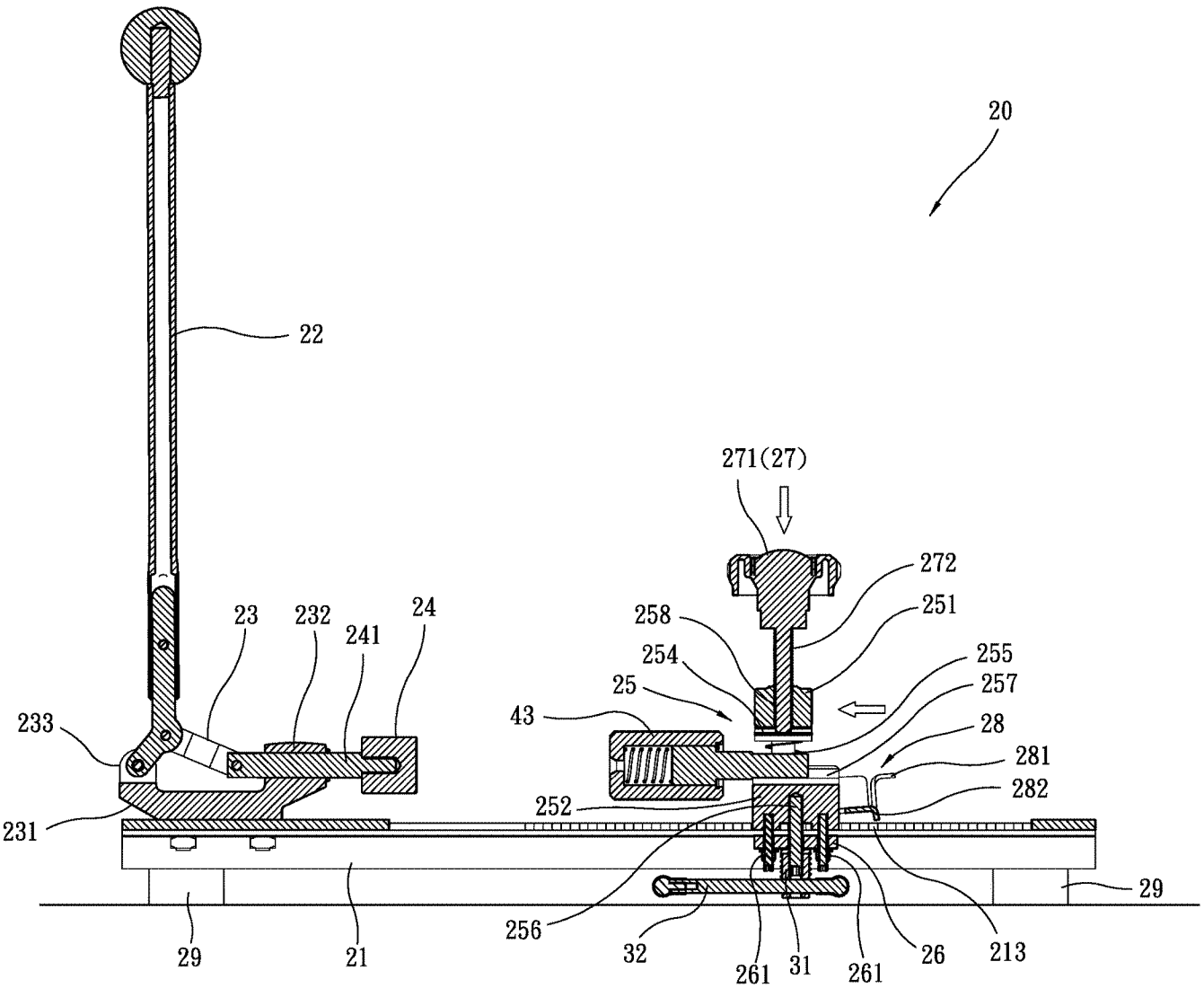

The fastening member 27 has an upper end that is formed with a rotary knob 271. A bolt 272 extends downward from a bottom of the rotary knob 271. The bolt 272 is screwable into the threaded hole 258 of the upper seat 251. The bolt 272 has a lower end that is contacting and engageable with the holding plate 254 as abutting thereon. Through continuously screwing downward the fastening member 27, the holding plate 254 is continuously driven downward to clamp and securely fix a portion of the supporter 43 that is disposed in the receiving trough 257 of the lower seat 252 (as shown in FIG. 7).

The stop member 28 has two opposite side parts that are respectively pivotally coupled to two side surfaces of the lower seat 252 such that an end of the stop member 28 is liftable upward. An end of the stop member 28 that is opposite to the pivots of the side parts thereof is provided with, on each of two opposite sides thereof, with a manual operation section 281. A portion of the stop member 28 that is between the manual operation sections 281 is provided, on a bottom thereof, with a downward-extending fixing plate 282. The fixing plate 282 is selectively insertable into opposite tooth troughs 213 on the two sidewalls of the elongate hole 211 to thereby fix the retainer 25 in position without further movement; oppositely, the fixing plate 282 is selectively removable from or disengageable from the opposite tooth troughs 213 on the two sidewalls of the elongate hole 211 so that the lower seat 252, the upper seat 251, the fastening member 27, and the stop member 28 are allowed to do reciprocal movement along and on the base 2.

The clamp plate 26 is disposed under the elongate hole 211 of the base 21 and is coupled to the lower seat 252 by means of two connection bolts 261 and nuts 262. The two connection bolts 261 extend through the elongate hole 211 and are screwed and attached to a bottom of the lower seat 251. The lower seat 252, the base 21, and the clamp plate 26 are not coupled together in a tightened manner, and instead, they are loosely attached to each other so that the retainer 25 and the clamp plate 26 are allowed to do reciprocal movement on and along the base 21. The clamp plate 26 is formed with a through hole 263 in a middle portion thereof and the through hole 263 allows the screw rod 256 of the lower seat 252 to extend therethrough. The tightening assembly 30 comprises a nut 31 and a rotation bar 32.

Figure 5:
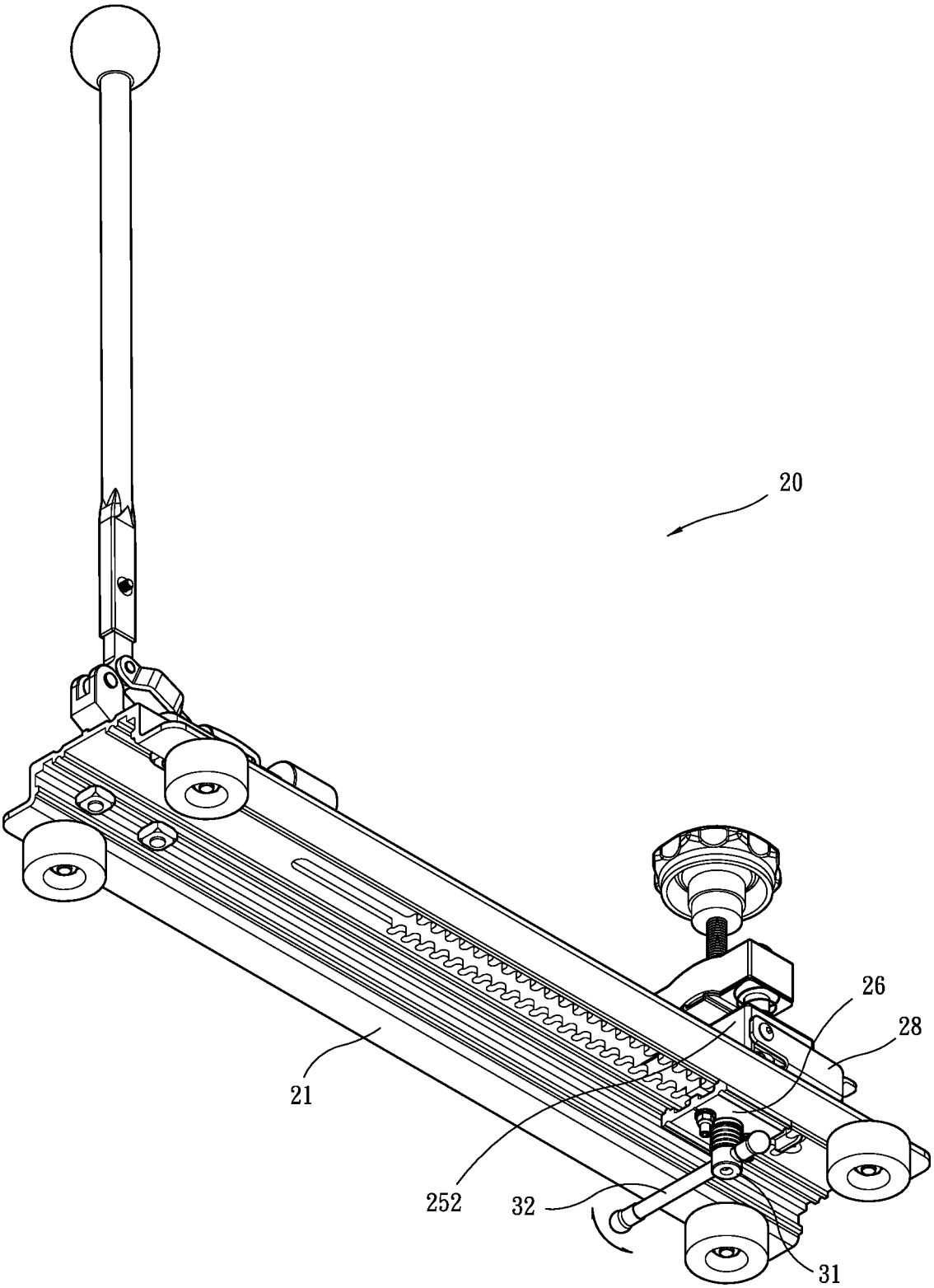
Figure 6:
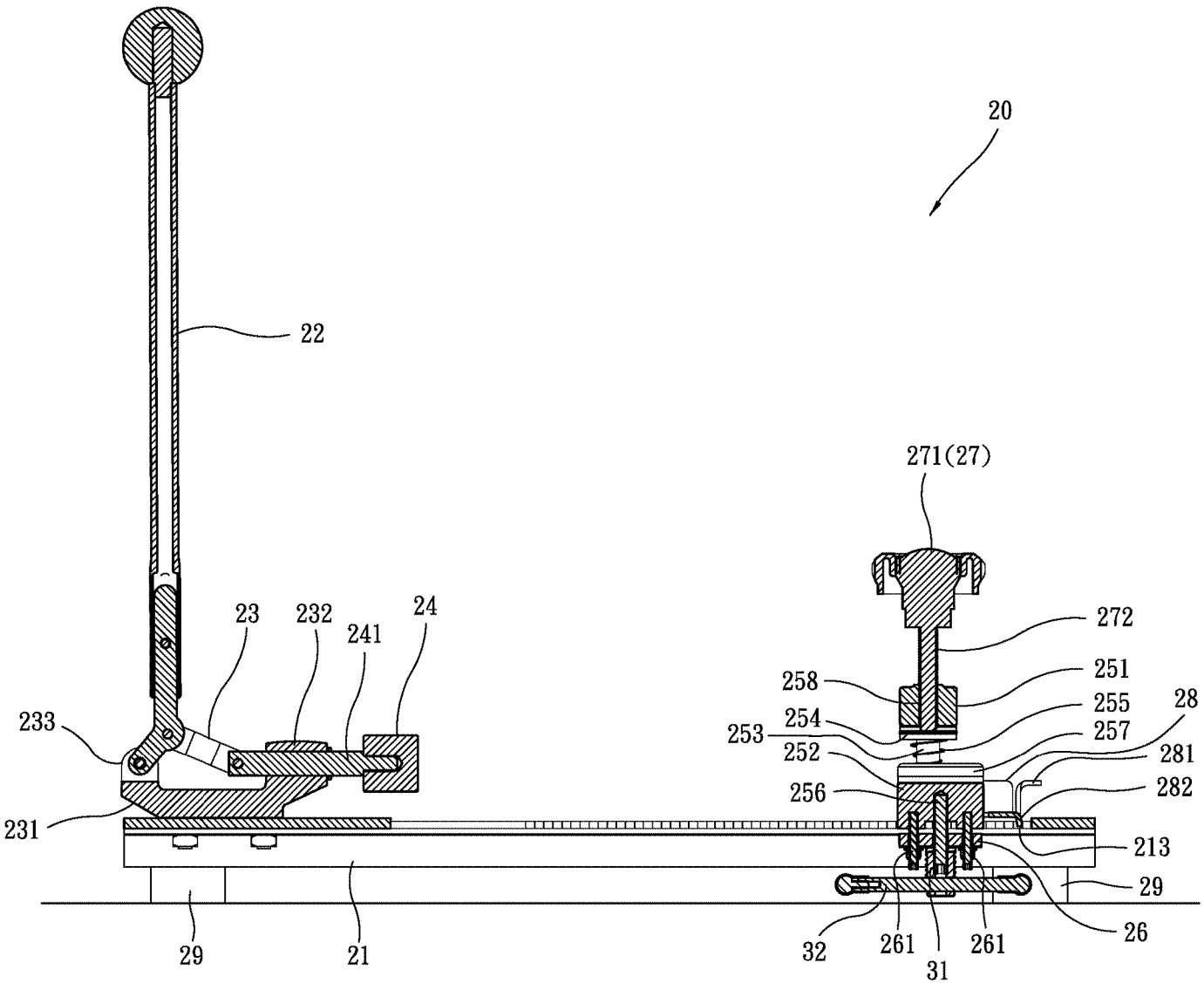
FIGS. 6 and 7 are cross-sectional views illustrating an operation of position adjustment of the embodiment of the present invention.

The rotation bar 32 penetrates, preferably in a horizontal direction, through the nut 31 and is rotatable so that the rotation bar 32 drives the nut 31 to rotate. The rotation bar 32 has two opposite ends that are expanded so that the rotation bar 32 is prevented from detaching from the nut 31; however, the rotation bar 32 is allow to reciprocally move with respect to the nut 31 so that one of the ends of the rotation bar 32 may be caused to approach the nut 31, while the other one of the ends is moved away from the nut 31. The nut 31 is screwed to the screw rod 256 of the lower seat 252 so that the rotation bar 32 that drives the nut 31 to rotate may make the lower seat 252, the base 21, and the clamp plate 26 tightened to each other or released from each other (as illustrated in FIG. 5). The nut 31 is provided, on a top end face thereof, with a washer 311 having an outside diameter greater than that of the nut 31. The nut 31 is provided with a spring 312 encompassing a circumference thereof so that the spring 312 is kept, by a spring force thereof, in contact with the rotation bar 32, in order to prevent random movement of the rotation bar 32.

The above provides a description to components of a writing instrument compressing device 20 according to a preferred embodiment of the present invention, as well as assembling thereof. The following provides a description to an operation of the present invention.

Figure 8:
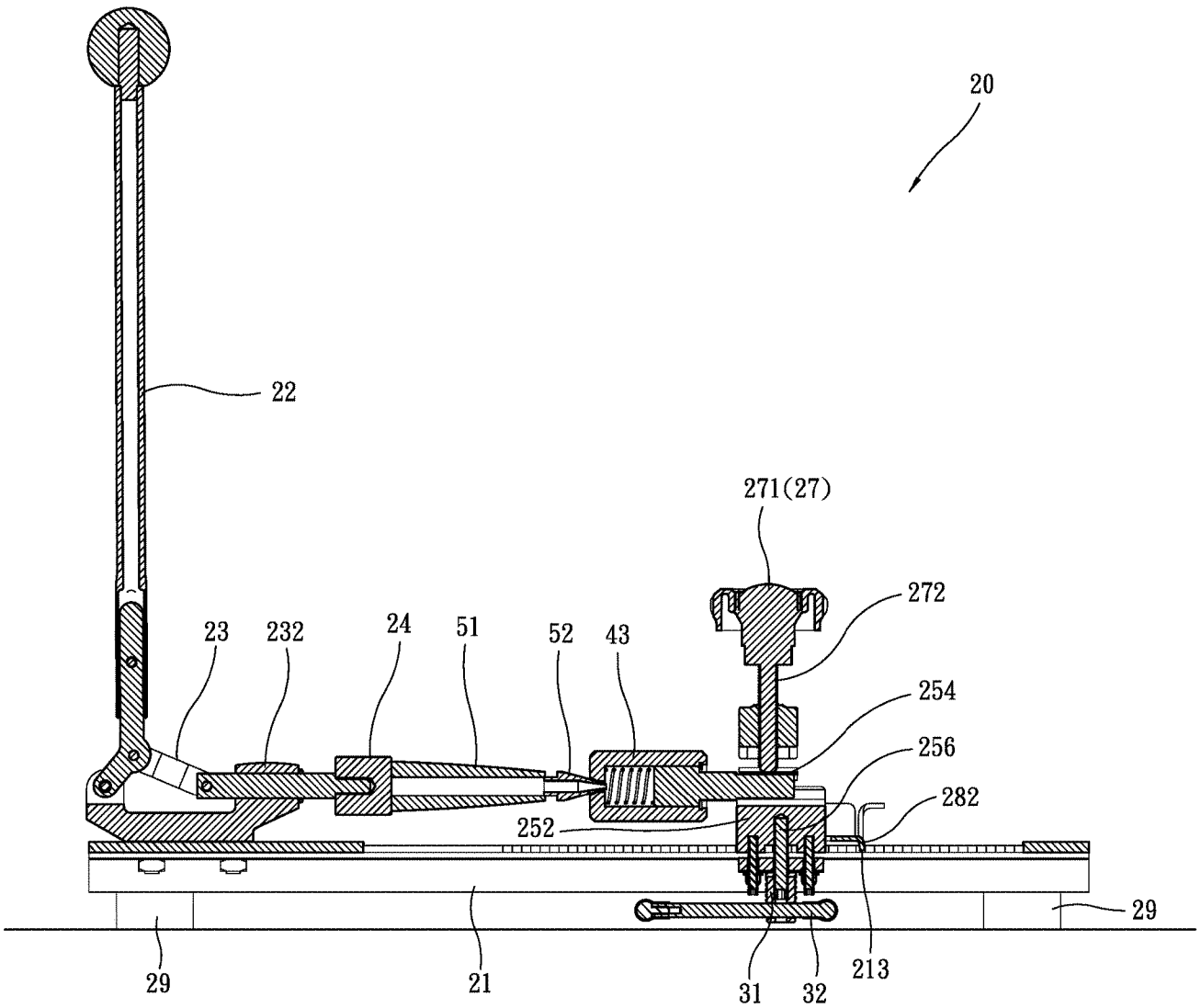
FIGS. 8 and 9 are cross-sectional views illustrating an operation of compression by the embodiment of the present invention.
Figure 9:
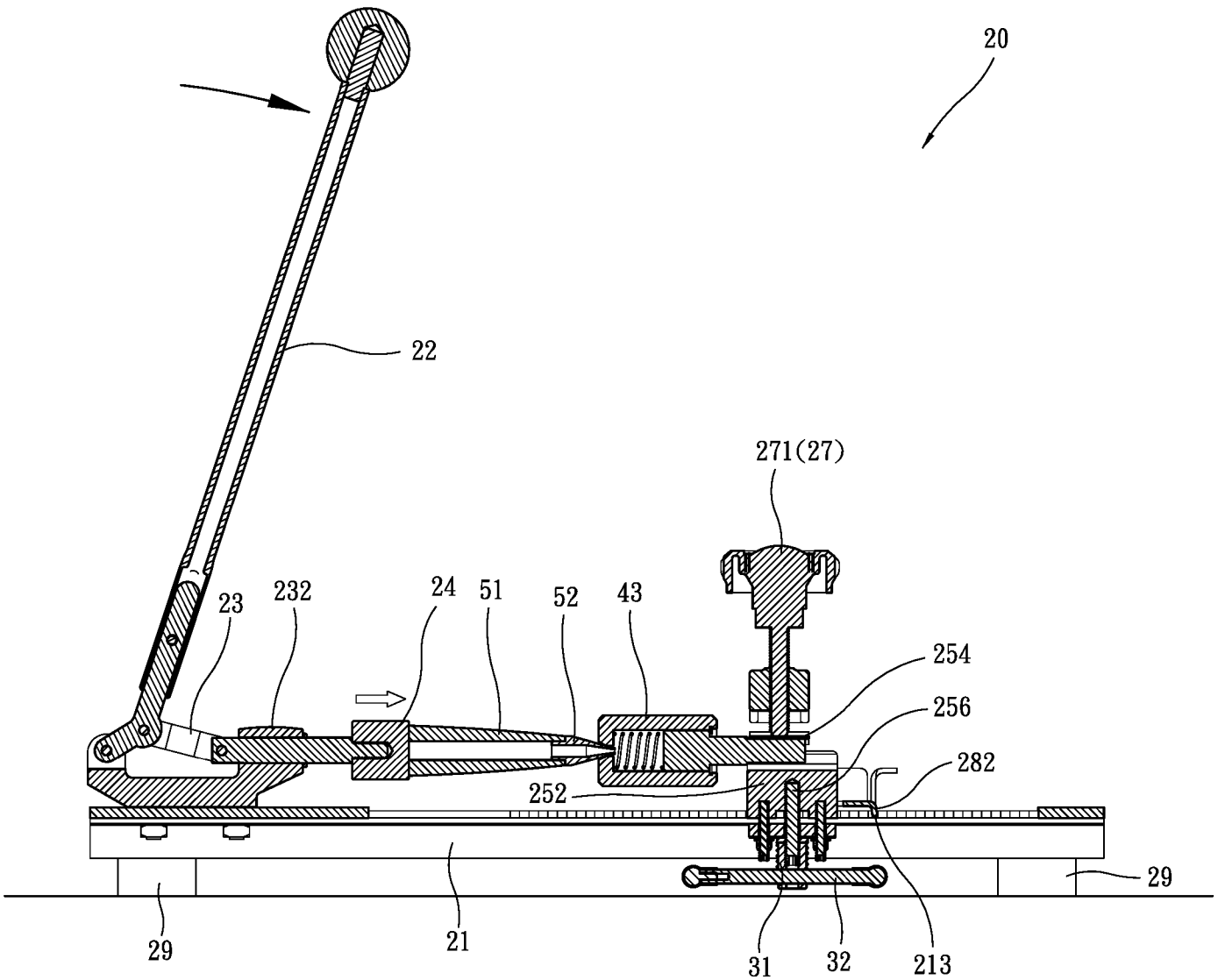

Referring to FIGS. 7-9, the writing instrument compressing device 20 according to the instant embodiment of the present invention, when put into operation, is arranged to have an end of the supporter 43 disposed in the receiving trough 257 of the lower seat 252 and the rotary knob 271 is rotate to move downward such that the bolt 272 on the underside of the rotary knob 271 pushes, continuously, the holding plate 254 to move downward to press onto the supporter 43. Further screwing would make the supporter 43 clamped and securely fixed between the holding plate 254 and the lower seat 252. Since in this invention, only one single rotary knob 271 is necessary to achieve the effect of securely fixing, the operation can be effectively improved in respect of efficiency thereof. Next, the manual operation sections 281 of the stop member 28 are operated to lift up the stop member 28 so as to have the fixing plate 282 separate from and disengage from the tooth troughs 213 on the two sidewalls of the elongate hole 211, and then, the retainer 25 is allowed to move in a direction toward the pusher 24, such that when the retainer 25 reaches a desired location, the rotation bar 32 is manipulated to have one end thereof moved close to the nut 31 thereby making one side of the rotation bar 32 exhibiting a greater length, and at the same time, the base 21, due the height thereof being raised up by the plurality of raiser pieces 29, forms a clearance or gap with respect to a carrying surface, allowing a user's finger to reach therein for manipulating the rotation bar 32 to rotate (as shown in FIG. 5), whereby the nut 31 is caused to screw and move upward to securely fix the lower seat 252, the base 21, and the clamp plate 26 together. As such, even though a force is applied to act on the retainer 25, no positional or angular deviation can be caused.

Referring to FIGS. 8 and 9, a writing instrument body 51 and a writing instrument head portion 52 (the writing instrument head portion 52 being one of parts of the writing instrument) that are to be combined with each other are positioned against each other and are disposed between the supporter 43 and the pusher 24 by being set in contact engagement with and thus supported by the supporter 43 and the pusher 24. Further application of a force to the handle rod 22 would make the handle rod 22 rotate downward to cause the link bar 23 to drive the pusher 24 to make movement toward the writing instrument body 51. Since the retainer 25, the base 21, the clamp plate 26, and the nut 31 are securely fixed together already, the retainer 25 is kept in position without moving, so that when the writing instrument head portion 52 is being inserted or fit into the writing instrument body 51, they are combined in a condition of being arranged in linear alignment with each other and the coupling therebetween is not carried out in a manner that an angle may be presented therebetween. As such, no cracking or breaking of the writing instrument body 51 and the writing instrument head portion 52 may occur.

Figure 10:
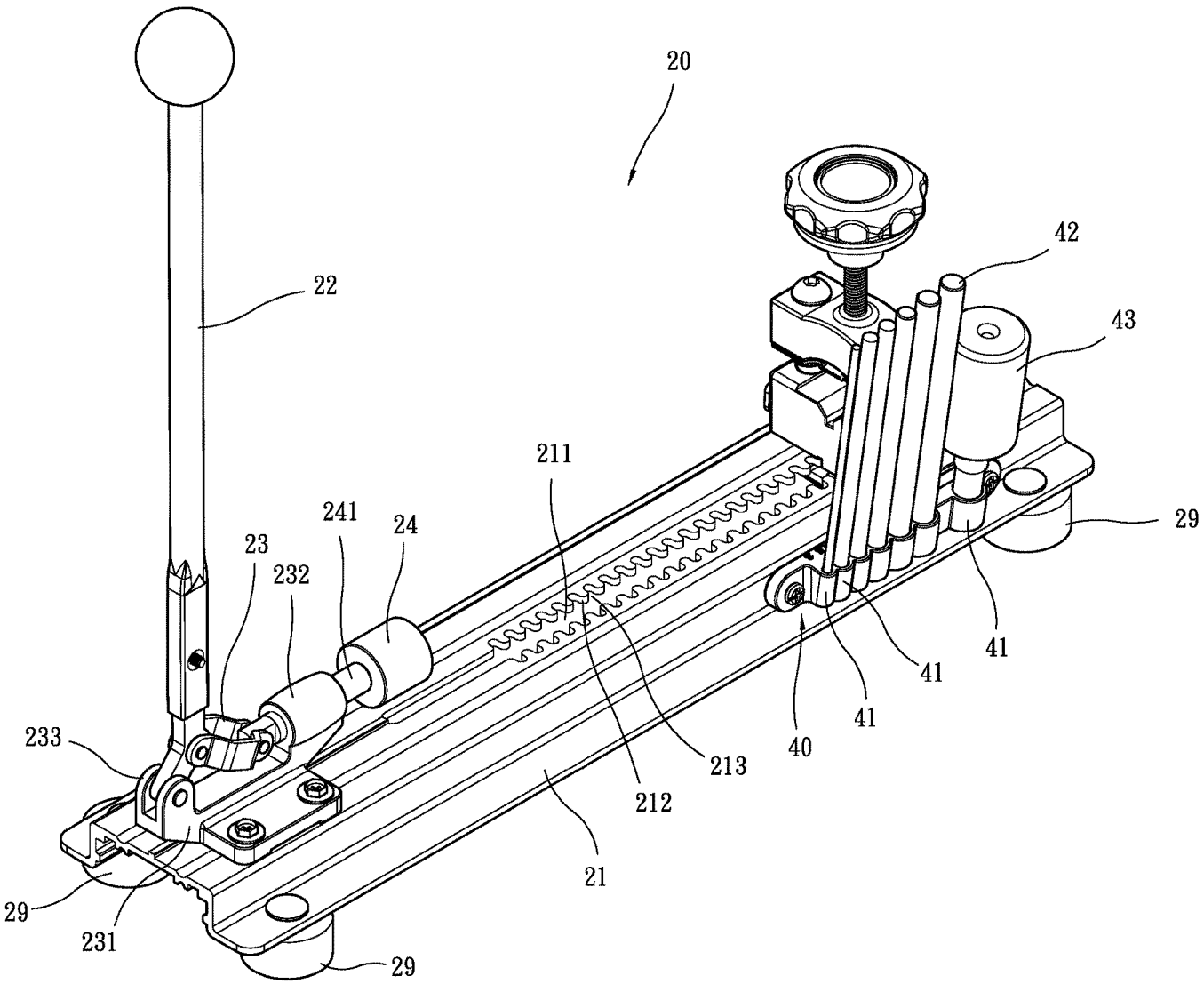
FIG. 10 is a perspective view illustrating storage of tool elements of the embodiment of the present invention.
Figure 11:
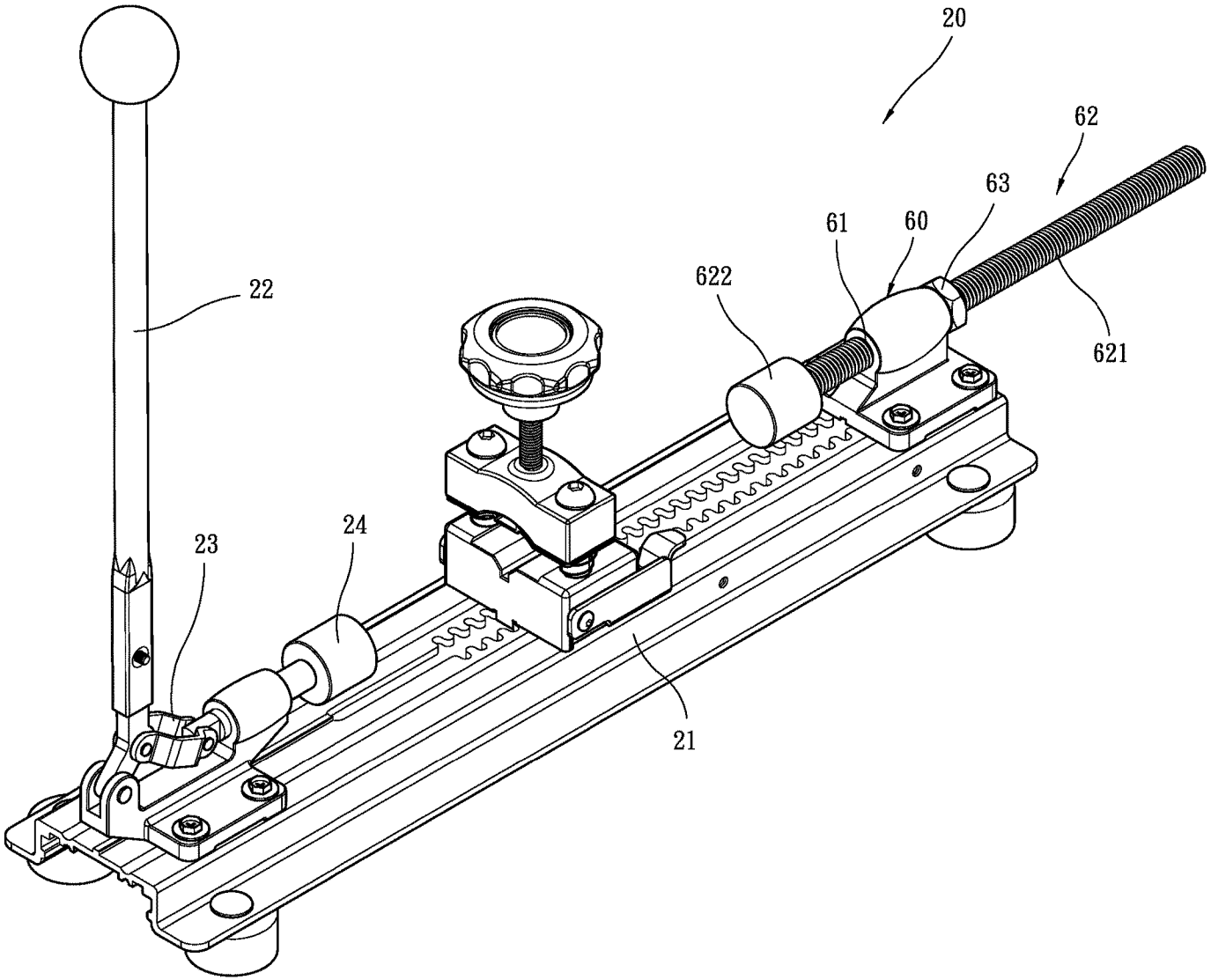
FIG. 11 is a perspective view illustrating a modified embodiment of the present invention including a tail seat attached thereto.
Figure 12:
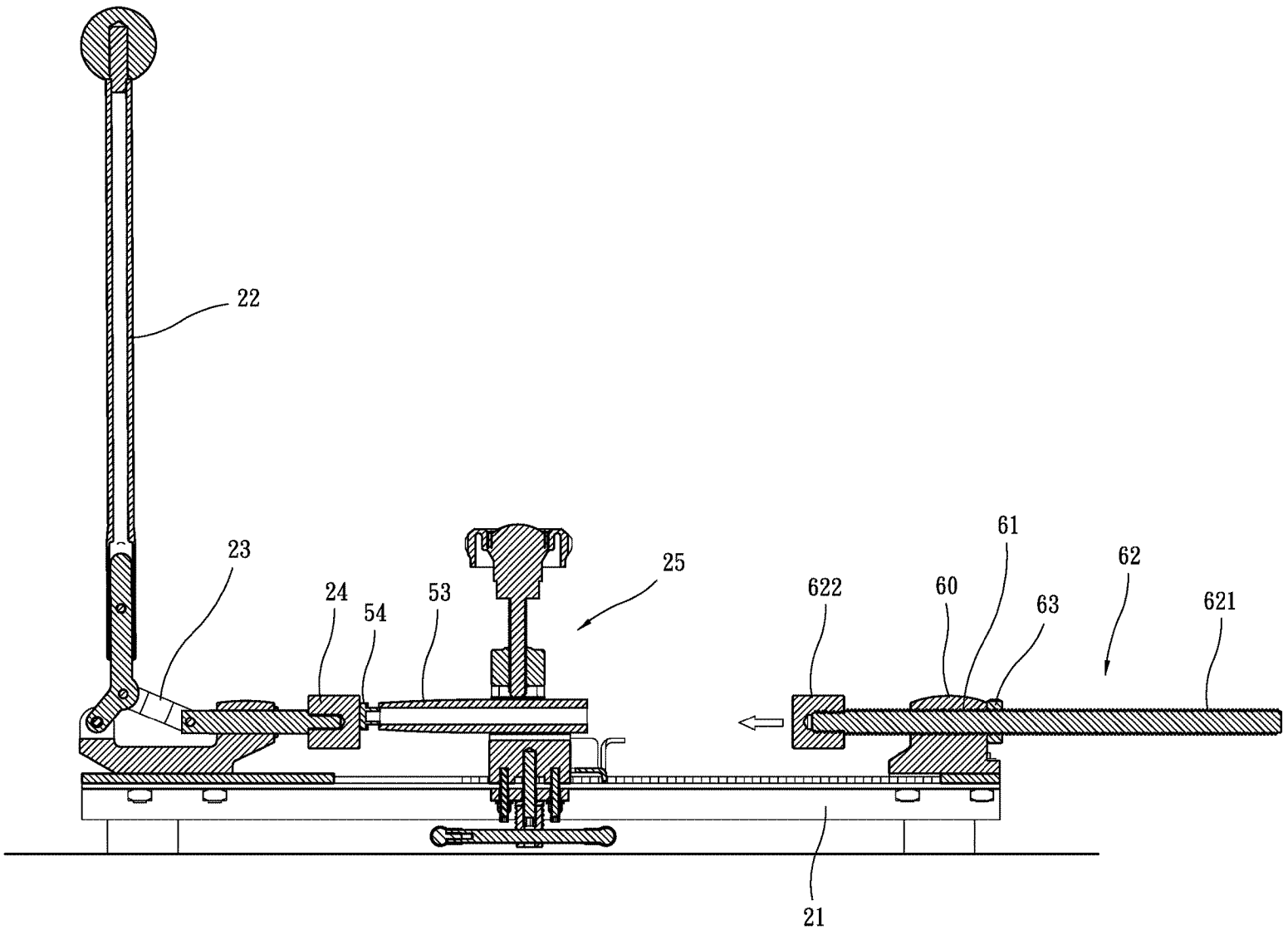
FIGS. 12, 13, and 14 are cross-sectional views illustrating an operation of compression by means of the tail seat of the modified embodiment of the present invention.
Figure 13:
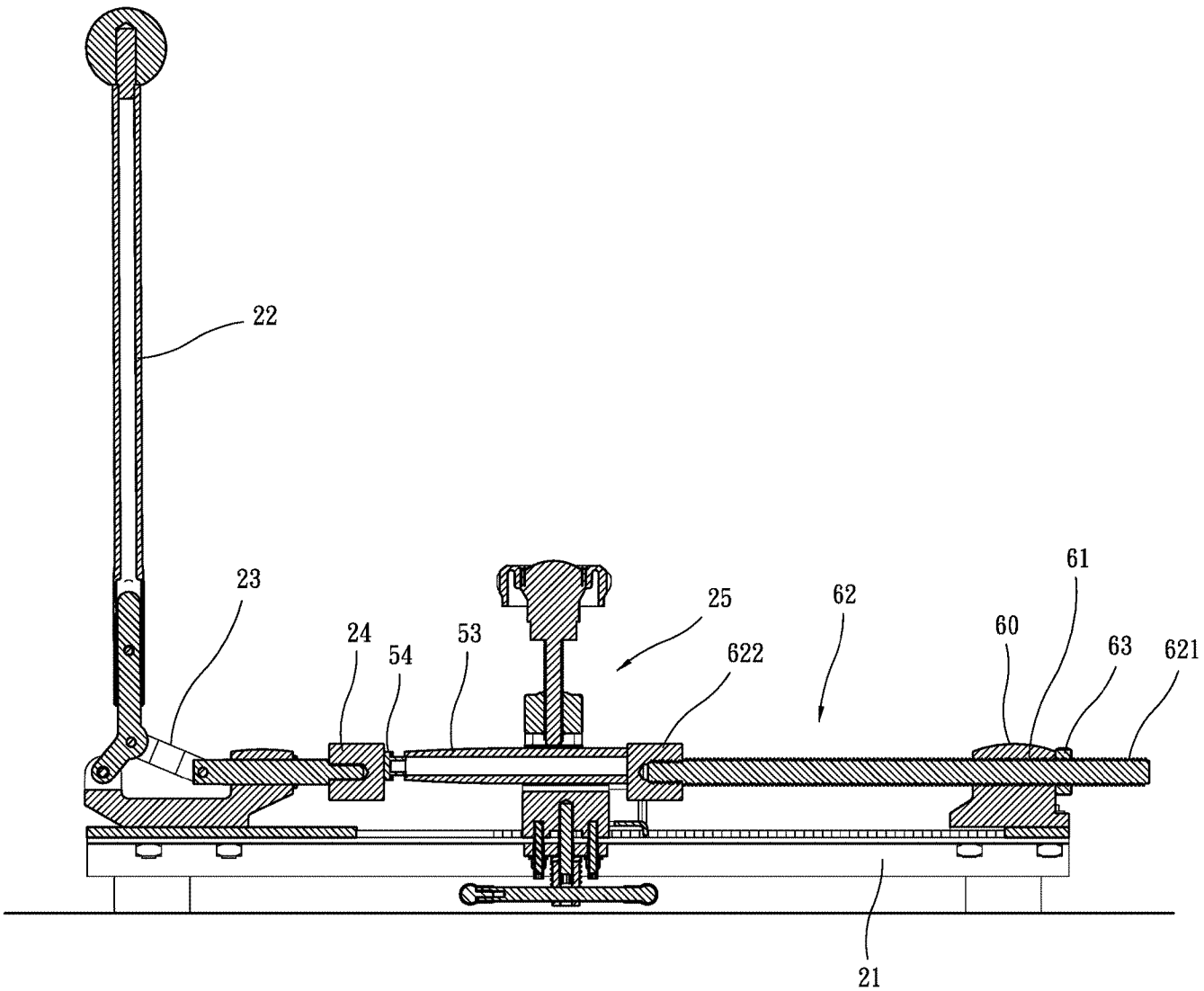
Figure 14:
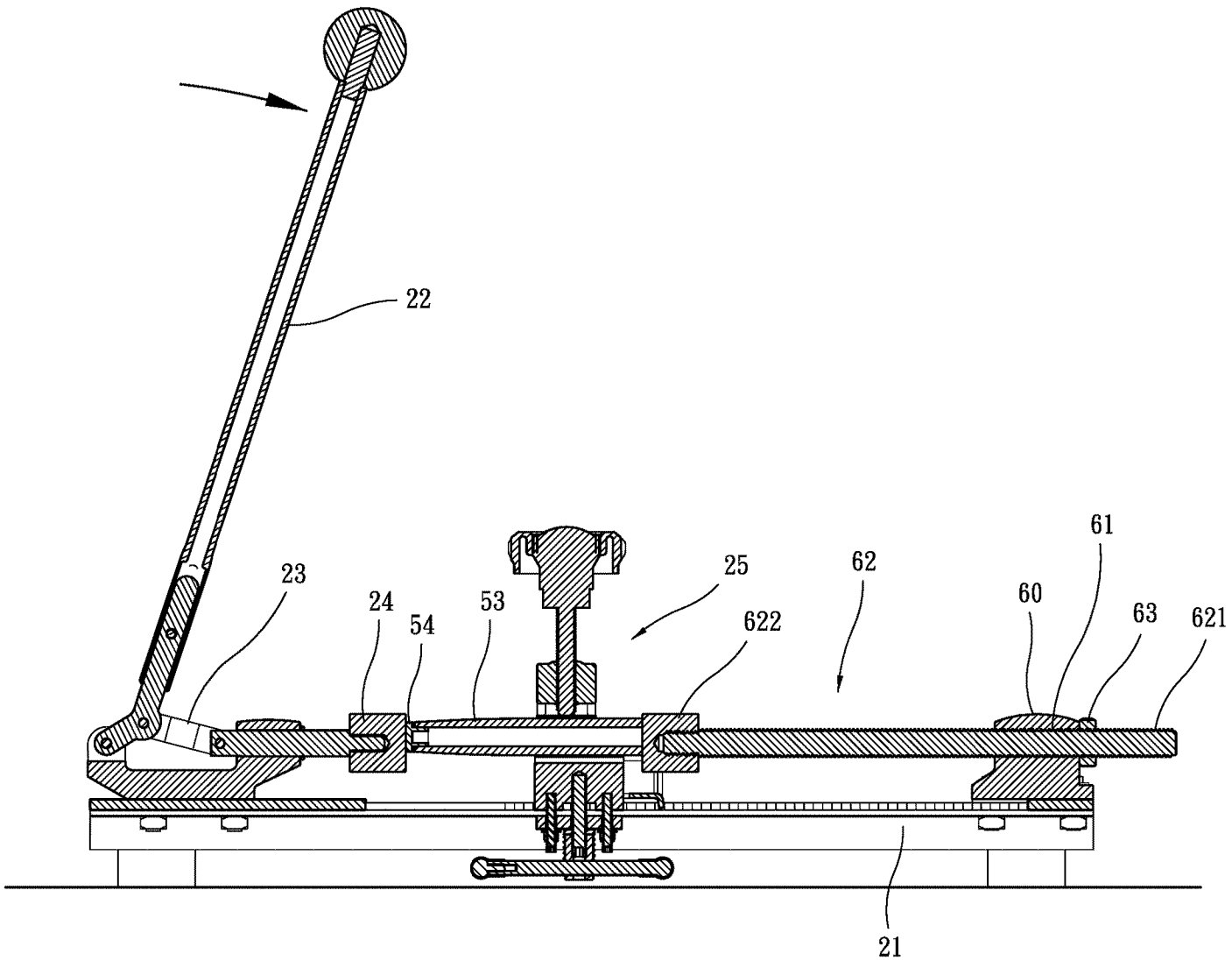

Referring to FIG. 10, a number of tools may be necessary in an operation of the writing instrument compressing device 20, a receptacle member 40 is provided at one side of the base 21. The receptacle member 40 comprises receiving cavities 41 having different sizes or specifications so that each of the receiving cavities 41 may receive and hold therein pushers or pushing members 43 of different sizes and/or supporters or supporting members 43 of different sizes, allowing for easy access and use by a user.

Referring to FIGS. 10-13, a modified embodiment of the writing instrument compressing device 20 according to the present invention additionally comprises a tail seat 60 that is attached to an end of the base 21. The tail seat 60 is formed with an internally-threaded hole 61 penetrating therethrough and having open ends. The internally-threaded hole 61 receives a driving member 62 screwed therein to be in screw engagement therewith. The driving member 62 comprises an elongate screw 621. A driving block is attached to an end of the screw 621. The elongate screw 621 is screwed in the internally-threaded hole 61 of the tail seat 60 such that clockwise rotation or counterclockwise rotation of the elongate screw 621 cause the elongate screw 621 to move linearly forwardly and backwardly. A nut 63 is screwed on the elongate screw 621 so that when the nut 63 is screwed tightly against and the tightened to an end of the tail seat 60, the elongate screw 621 is locked and prevented from further rotation or movement and thus, the driving block 622 is fixed at a specific location without movement. Further referring to FIGS. 12 and 13, a writing instrument rear body 53 is clamped and fixed in the retainer 25 to be combined with a writing instrument plug 54 (the writing instrument plug 54 being one of the parts of the writing instrument), the driving member 62 is rotated to move in a direction toward the retainer 25 such that the driving block 622 abuts an end of the writing instrument rear body 53. The nut 63 is then screwed to tighten against the end of the tail seat 60 to fix the elongate screw 621 in position without further moving. A force may then be applied to the handle rod 22 for rotating downward to drive the link bar 23 to cause the pusher 24 to move toward the writing instrument rear body 53. With the driving block 622 abutting and supporting the writing instrument rear body 53, the writing instrument plug 54 may be smoothly fit into the writing instrument rear body 53 to be combined therewith. Since a distance of movement of the driving member 62 in a forward direction or a backward direction can be adjusted through clockwise or counterclockwise rotation of the elongate screw 621, assembling operations for writing instrument bodies 51 or writing instrument rear bodies 53 of different lengths or specifications can be carried out.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A writing instrument compressing device, comprising:

a base, which has an underside on which a plurality of raiser pieces are mounted and adapted to separate the base from a carrying surface by a distance in a vertical direction, the base being formed with an elongate hole, the elongate hole being defined by two opposite sidewalls, which are provided, in a manner of corresponding to and opposite to each other, tooth ridges and tooth troughs arranged alternate with each other;

a handle rod, which is pivotally coupled to an end of the base to drive a pusher to reciprocally move;

a retainer, which is reciprocally movable along the elongate hole of the base, the retainer at least comprising an upper seat and a lower seat, the upper seat and the lower seat being spaced from each other by a distance by two support posts that are coupled to the upper seat and the lower seat, a holding plate being arranged between the upper seat and the lower seat, the holding plate receiving the two support posts to extend therethrough, the holding plate being movable along the two support posts in the vertical direction, each of the support posts being provided with a spring encompassing an outer circumference thereof, each of the springs being located between the holding plate and the lower seat, the lower seat having a bottom surface on which a screw rod is provided to extend through the elongate hole of the base;

a fastening member, which is screwed into the upper seat, the fastening member having an upper end forming rotary knob, a bolt extending downward from a bottom of the rotary knob, the bolt having a lower end contacting and engageable with the holding plate, such that screwing the fastening member downward drives the holding plate to move downward; and a tightening assembly, which comprises a nut and a rotation bar that penetrates through the nut and is rotatable, the nut being screwed to the screw rod on the bottom surface of the lower seat of the retainer, the rotation bar having two ends, wherein one of the two ends is movable close to the nut, while the other one of the two ends is moved away from the nut, the nuts being driven by the rotation bar to tighten the retainer and the base or to be loosened to allow the retainer to reciprocally move on and along the base.

2. The writing instrument compressing device according to claim 1, wherein the base is provided at one end thereof with a pivot seat, the pivot seat being provided, on one side thereof, with a pivot pin and being also provided, on an opposite side thereof, with a guide section, the guide section being formed with a channel extending through opposite ends thereof, the handle rod has a lower end having one side pivotally coupled with the pivot pin of the pivot seat and an opposite side pivoted to a link bar; and the pusher has an end that is reduced in outside diameter to form a reduced section, which is received through the guide section to pivotally couple to the link bar, and an opposite end that is expanded.

3. The writing instrument compressing device according to claim 1, where the spring that encompasses each of the support posts comprises turns having diameters that are expanded from one end of the spring toward an opposite end so that the turns do not stack on each other when the spring is compressed.

4. The writing instrument compressing device according to claim 1, wherein the retainer comprises a stop member pivotally coupled thereto, such an end of the stop member that is opposite to the pivotal coupling is upward liftable, the stop member at least comprising a manual operation section, the stop member having a bottom that is provided with a fixing plate extending downward, the fixing plate being arranged to correspond, in position, to the elongate hole of the base.

5. The writing instrument compressing device according to claim 1, further comprising a clamp plate, which is disposed under the elongate hole of the base and is coupled to the lower seat by two connection bolts and nuts, the two connection bolts extending through the elongate hole and screwed and attached to the lower seat, wherein the lower seat, the base, and the clamp plate are coupled together in a manner of being securely fixed so that the retainer and the clamp plate are allow to selectively reciprocally move on the base, the clamp plate being formed with a through hole, the through hole receiving the screw rod on the bottom surface of the lower seat to extend therethrough.

6. The writing instrument compressing device according to claim 1, wherein the nut of the tightening assembly is provided with a washer having an outside diameter greater than an outside diameter of the nut to stack on an end face of the nut, a spring encompassing an outside circumference of the nut.

7. The writing instrument compressing device according to claim 1 further comprising a tail seat, wherein the tail seat is mounted to an end of the base and the tail seat is formed with an internally-threaded hole penetrating therethrough, the internally-threaded hole receiving a driving member screwed therein, the driving member comprising an elongate screw, a driving block being attached to an end of the elongate screw, the elongate screw being screwed in the internally-threaded hole of the tail seat such that rotation of the elongate screw in a first angular direction or a second, opposite angular direction causes the elongate screw to move forward or backward.

8. The writing instrument compressing device according to claim 7, where a nut is screwed on the elongate screw and is rotatable for tightening against the tail seat or released therefrom.

* * * * *